United States Patent [19]

Adair

[11] 4,031,697

[45] June 28, 1977

[54] COMBINATION STEAM-GAS GENERATOR ENGINE

[76] Inventor: Joseph Bryan Adair, 2103 Vanderbilt Lane, Austin, Tex. 78723

[22] Filed: Apr. 18, 1976

[21] Appl. No.: 675,071

[52] U.S. Cl. ..... 60/39.55; 60/39.35

[51] Int. Cl.[2] ..... F02C 7/00

[58] Field of Search ..... 60/39.53, 39.55, 39.34, 60/39.35, 39.05, 39.46 S

[56] References Cited

UNITED STATES PATENTS

| | | | |
|---|---|---|---|
| 1,618,808 | 2/1927 | Burg | 60/39.46 S |
| 2,424,610 | 7/1947 | Goddard | 60/39.35 |
| 2,536,599 | 1/1951 | Goddard | 60/39.55 |
| 2,563,029 | 8/1951 | Goddard | 60/39.55 |
| 2,707,444 | 5/1955 | Van Loon | 60/39.46 S |
| 3,238,719 | 3/1966 | Harslem | 60/39.55 |

OTHER PUBLICATIONS

"Vorkauf Rotating Boiler and Rotating Boiler Gas Turbine" (British Intelligence Objective Sub-Committee), 1946, p. 10, FIG. 11.

*Primary Examiner*—Carlton R. Croyle
*Assistant Examiner*—L. J. Casaregola

[57] ABSTRACT

The invention contemplates a combination steam-gas generator engine having a rotatable burner can that is provided with a cylindrical exposed inner water wall jacket-liner that is held in place by the centrifugal force generated by rotation of the burner can such that the portion of the radiated heat absorbed by the water jacket-liner is used to develop a contributory supply of water vapor or steam that enters the power providing fluid flow stream, such that said water jacket-liner serves both as a heat shield and as a source of energy laden fluid.

17 Claims, 3 Drawing Figures

COMBINATION STEAM-GAS GENERATOR ENGINE

SUBJECT MATTER OF THE INVENTION

This invention relates to combination steam-gas generator engines and more specifically relates to steam-gas generator engines employing a liquid lined rotary burner can.

OBJECTS OF THE INVENTION

Characteristic gas turbine engine practice calls for the compression of excess combustion air for the purpose of cooling the combustion container and power turbine pants. It is therefore a primary object of this invention to lower the required amount of compressed input air by the provision of a water lined combustion chamber which, more specifically, is a rotary can burner containing a cylindrical wall of vaporizable liquid fluid.

Common gas turbine practice also produces engine exhaust temperatures well in excess of the boiling point of water, the temperature in excess of the boiling point of water representing energy which, if recoverable, is currently wasted. It is therefore a primary object of this invention to recover more energy than is commonly done from the combustion gas fluid while within the engine and converting the recovered energy into useful power by the provision of an internal water source that will absorb heat from the flowing burned gas stream and thereby evaporate, adding additional vapor fluid to the existing burned gas stream such that more energy is recoverable by a power absorption unit, the water source being more specifically a cylindrical wall of vaporizable liquid fluid held within a burner can combustion chamber.

Another object of the invention is to prevent the combustion flame from being extinguished by frothing and foaming of the cylindrical liquid wall during the vaporization process by the provision of flame gallery liners that partially shade the cylindrical liquid wall from the direct radiant heat generated by the combustion flame.

Another object of the invention is to promote direct conduction of heat into the cylindrical water wall by the provision of flame gallery liners which receive direct heat radiated from the combustion flame and conduct the thus captured heat into the cylindrical liquid wall, and by a plurality of depending heat transfer fins that extend into the flow of heated gas-vapor fluid and capture heat from the fluid, the heat being then conducted outward into the cylindrical liquid wall causing additional liquid to evaporate and enter the flowing mass of gas-vapor fluid.

Another object of the invention is to provide a gas-vapor generator that supplies an energy-laden fluid flow of moderate temperature that may be used to operate a power turbine of conventional design but made of readily available non-critical moderate alloy metals.

These and other objects and advantages of this invention will become apparent through consideration of the following description and appended claims in conjunction with the attached drawings in which:

Figure 1:
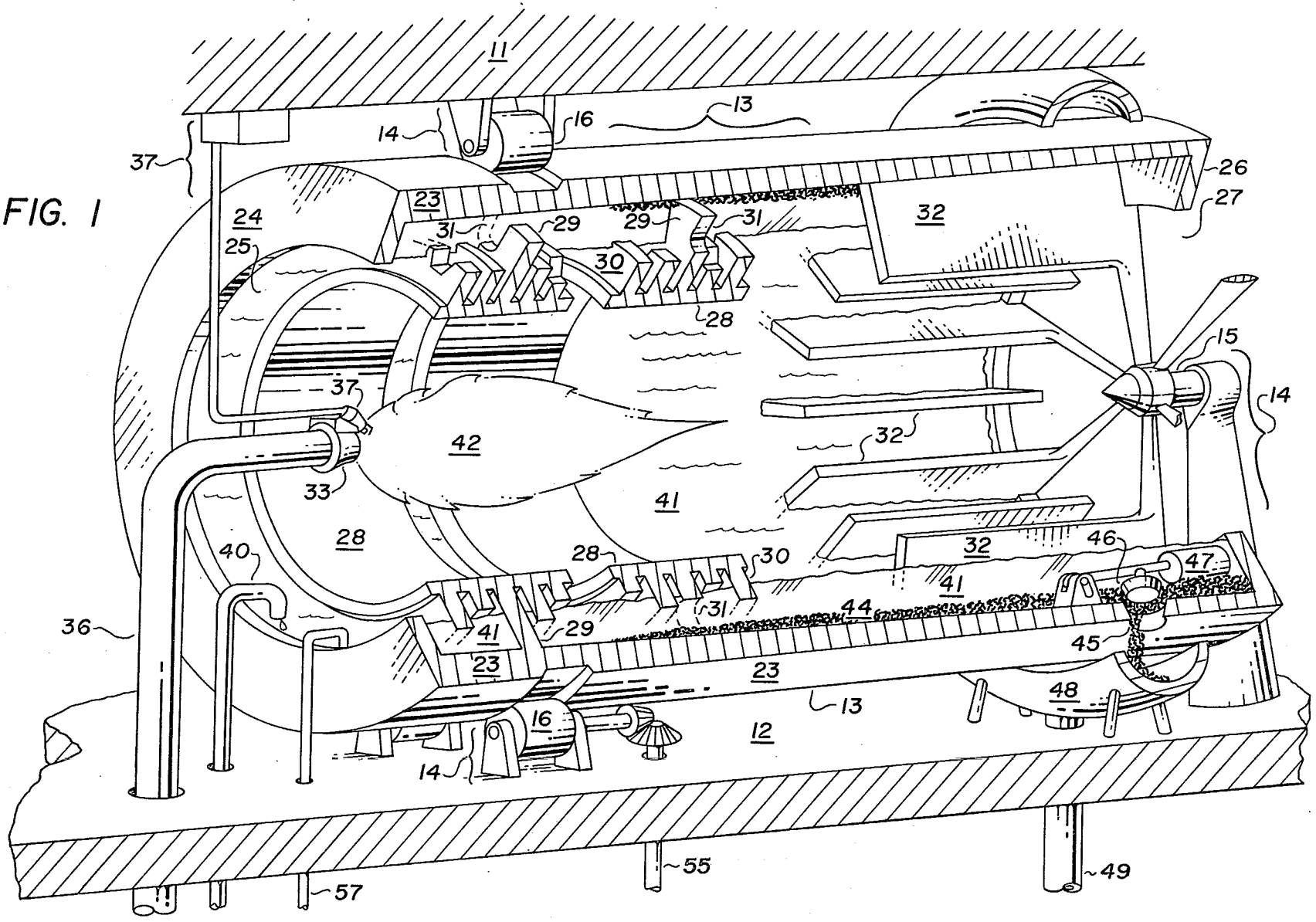
FIG. 1 is a cutaway perspective view of the rotary burner can portion of the invention.

In describing one selected form or preferred embodiment of this invention as shown in the drawings and in this specification, specific terms and components are used for clarity. However, it is not intended to limit the claimed invention to the specific form, components, or construction shown and it is to be understood that the specific terms used in this illustration of the invention are intended to include all technical equivalents which operate in a similar manner to accomplish a similar purpose.

DETAILED DESCRIPTION OF THE PREFERRED EMBODIMENT OF THE INVENTION

Figure 3:
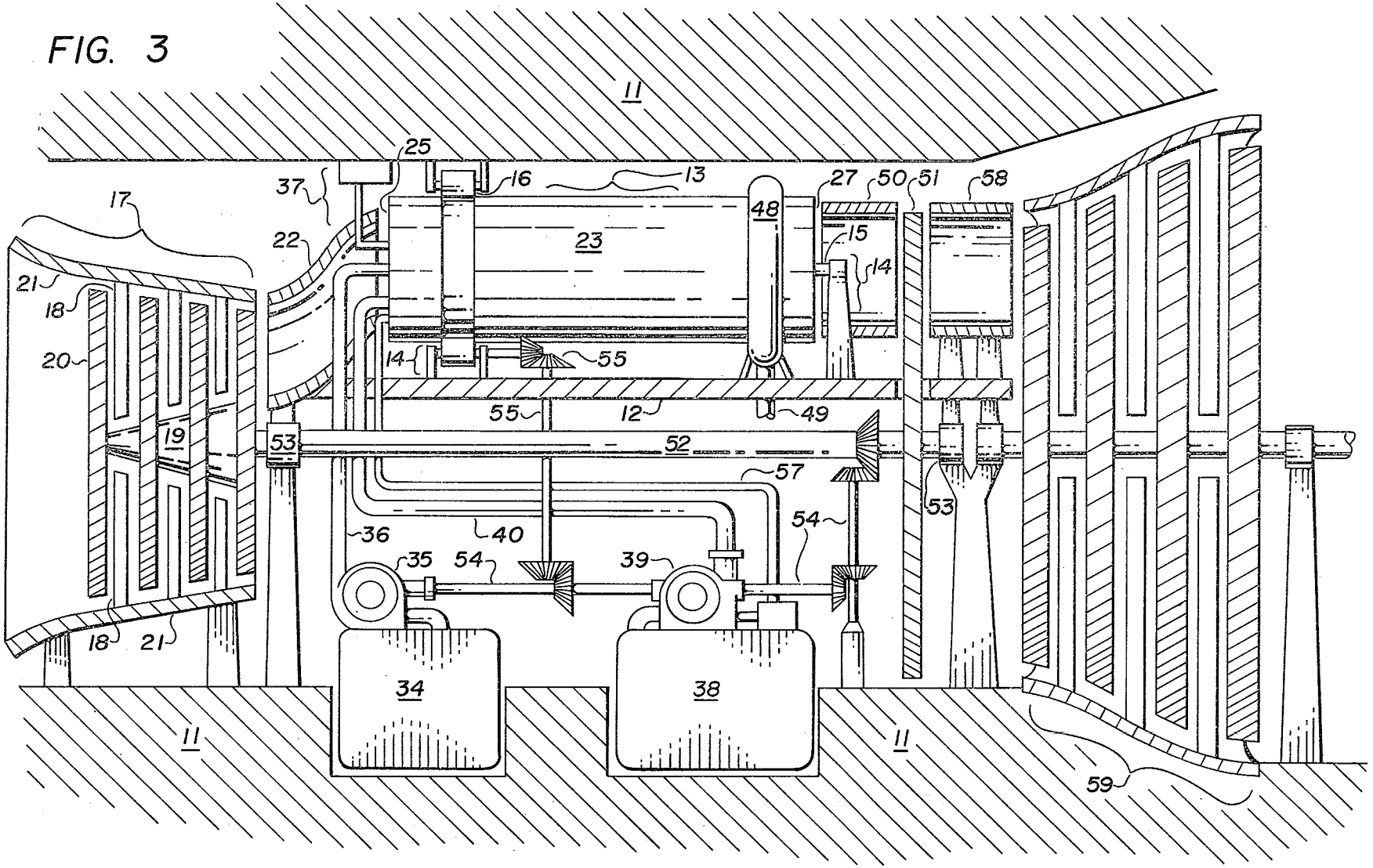
FIG. 3 is a schematic representation of a combination steam-gas generator engine in which said rotary burner can is employed.

Referring to the specific embodiment of the invention selected for illustration in the accompanying drawings, the improved combination steam-gas generator engine contemplated by this invention is illustrated generally in the overall context of an engine in FIG. 3 for completeness while the details of an improved rotary burner can are illustrated in perspective in FIG. 1 of the drawings. This detailed description will commence with an enumeration and an identification of the major overall elements of a combination steam-gas generator engine of the type that can provide the contextural environment for the inventive improvements contemplated and disclosed herein. Such an overall combination steam-gas generator engine would generally comprise a ground base support structure 11, a suitable engine bed frame 12, supported by conventional means at a spaced-apart distance from said ground base support structure, together with means for rotatably supporting a rotary can burner 13, a suitable input air compressor 17, a compressed air transmission duct 22 routed between the compressed air supply end of said input compressor and the input end of a rotary can burner, an improved generally horizontally positioned rotatably mounted hollow tubular can burner structure 13, provided with an inner liquid liner cylindrical wall of vaporizable liquid fluid 41, a fluid input means 25 at one end of the burner can, a fluid output means 27 at the opposite end of the burner can, means of supporting and providing rotary drive motion to the burner can 55–16 and 14, an auxiliary power turbine gas inlet duct 50 coupled to the downstream output end of the rotatably burner can, a driven auxiliary power turbine wheel 51 rotatably mounted in such position as to be driven by the gasseous fluid flowing from the rotatable burner can through the auxiliary power turbine gas inlet duct means of coupling rotative energy 52–54 and 55 developed by the auxiliary power turbine wheel to auxiliary and accessory equipment, a generated gas directive duct 58 coupled to a useful load device 59, means for supplying and controlling the flow of vaporizable liquid fluid into the burner can, together with means for supplying and controlling the flow of fuel to and through a suitable fuel injection nozzle 33 in the burner can.

Figure 2:
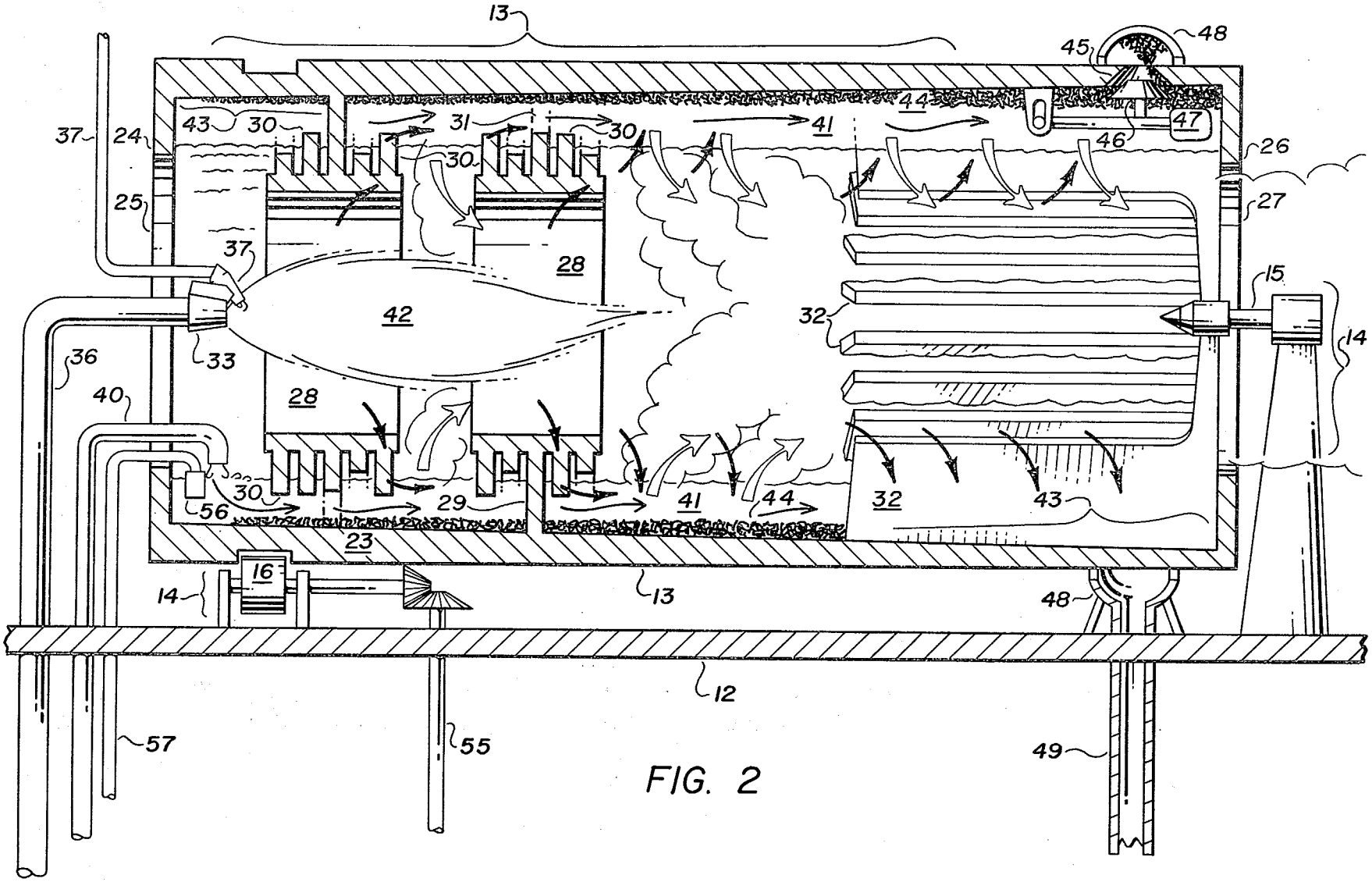
FIG. 2 is a cross section view of said rotary burner can portion of the invention.

A logical point of departure for describing this and most other engines would be to start with a suitable ground base support structure 11, which may be a conventional portion of the building in which the engine is housed or a suitable ground base foundation or mobile chassis on which the engine is constructed without attempting to attribute any special form or shape requirement for the engine described in this invention. Upon such ground base support structure there should be erected a suitable engine bed frame 12 of conventional shape and structure to support the various component parts of the engine described herein, with said engine bed frame 12 being supported by conventional means at a spaced-apart distance from the ground base support structure. A significant portion of the inventive engine combination disclosed herein relates to the provision of a generally horizontally positioned rotatably mounted hollow tubular can burner structure 13 which is illustrated in FIG. 1 and FIG. 2 of the drawings herein and will be discussed in greater detail at a later point in this disclosure. The existing art discloses a number of suitable ways of providing rotatable support means for rotary burner cans employed in other technologies including lime kilns and incinerators. Any such suitable rotatable can support means 14, 15, 16 that will permit rotary can burner 13 to be supported and rotated at a suitable position above engine bed frame 12 will satisfy the requirements of this invention, even though the drawings herein illustrate rotary can burner 13 as being rotatably supported by a spindle-hub and spoke assembly 15 at one end of said burner can and by a plurality of can positioning rollers 16 rollably mounted against the exterior surface of said burner can.

Said rotary can engine 13 is provided with a suitable input air compressor 17 which may include any suitable type of compressor stator assembly 18, a compressor rotor hub 19, a vaned-bladed rotor assembly 20 attached to said rotor hub with said compressor structure being positioned and mounted within a suitable compressor housing shroud 21. Although this disclosure has described an axial flow compressor it should be understood that the choice of a particular type of input air compressor is not a significant feature of the invention and that with suitable adjustments any of a wide variety of compressed air sources could be adapted to provide the compressed air input required by this invention. The type of compressed air transmission duct 22 will depend upon the nature and structure of the input air compressor employed and can be of any convenient form that will serve the purpose of routing the compressed air from the output of input air compressor 17 into the input end of rotary can burner 13.

Said generally horizontally positioned rotatably mounted hollow tubular can burner structure 13 is provided with a cylindrical outside wall 23 with a partial closure input lip ring 24 on the upwind end of the burner can leaving a suitable fluid input tuyere 25 at said upwind end, with a similar output lip ring partial closure 26 on the downwind end of said rotary can burner 13 leaving a fluid exit opening 27 at the exit end of said rotary can burner. The cylindrical wall and exterior features of said rotary can burner 13 may be fabricated from any suitably rigid heat resistant material and there is already a highly developed art of designing and fabricating suitable burner housing structures. This invention, however, contemplates the provision of a special flame gallery liner 28 of thermally conductive material concentrically mounted within the upwind portion of the burner can at a suitable spaced-apart distance from burner can wall 23 with said flame gallery liner being provided with at least one radial support web 29 member extending between and attached to the outer surface of the flame gallery liner and the inner surface of the burner can wall to provide a means of supporting and positioning the flame gallery liner 28 in the described concentric position within said rotary can burner. In addition it will usually be desirable to provide said flame gallery liner 28 with a plurality of heat transfer fins 30—30 extending from the interior wall of said flame gallery liner into the space between the flame gallery liner and the wall of the burner can. Since it will be necessary to have water or other suitable coolant-vapor source liquid flow in the space between flame gallery lines 28 and wall 23 of burner can 13 it will be desirable to provide a plurality of mouse-hole opening liquid passageways 31—31 cut through each of the web structures 29—29 employed to position and support said flame gallery lines 28. So far, this paragraph of the disclosure has mentioned rotary can burner structures provided with only a single flame gallery liner 28, but it will be readily appreciated that in some structural configurations and in cases where rotary can burner 13 is very large, it may be desirable to provide a plurality of flame gallery liners 28—28 arranged in successive or cascaded sequence within the input portion of the interior of said rotary burner can and FIG. 1 and FIG. 2 of the drawings herein illustrate two flame gallery liners installed in the illustrated rotary can burner.

Starting at an intermediate point within the interior length of said rotary can burner 13 at a spaced-apart distance from the trailing edge of the most downwind flame gallery liner 28—28 and extending through substantially the remainder of the interior length of the burner can, there is provided a plurality of generally longitudinal spaced-apart radial fins 32—32 extending inward from the inner wall of said rotatable burner can. It should be readily apparent that this particular sequence of radial fins 32—32 will absorb heat from the exiting combustion gasses thereby reducing the temperature of the combustion gasses being delivered to subsequent equipment such as a suitable power turbine unit with resultant protection of such unit. It should also be noted that the heat absorbed by said plurality of radial fins 32—32 will cause water or other vaporizable fluid used in the outer portion of rotary can burner 13 to boil and vaporize into steam which enters into and augments the flowing gas-vapor stream. This feature of the invention will be discussed further at a subsequent point in this disclosure.

There is also provided at or near the input end of rotary can burner 13 an appropriate fuel injection nozzle 33 which is connected to a fuel reservoir 34 or other suitable fuel source, together with a fuel pump 35 and appropriate connective fuel lines 36 to convey said fuel from fuel reservoir 34 to fuel injection nozzle 33. There should also be provided a suitable associated means of igniting fuel 37, to ignite fuel injected into the burner can which can be any suitable and appropriate ignition means known to the art and no specific form of ignition is commended as a unique part of this invention.

The invention contemplates that a suitable vaporizable liquid fluid, which may be water, supplied from vapor fluid reservoir 38 by means of vapor fluid pump 39 will be injected through vapor fluid line 40 into the interior of rotary can burner 13 so that a pool or body of said vaporizable liquid fluid occupies at least a portion of the space between cylindrical wall 23 of burner can 13 and the interior flame gallery liners 28—28, and said body of vaporizable fluid will extend completely along the length of the interior of cylindrical wall 23 of burner can 13. It is contemplated that said rotary burner can 13 will be rotated at a very high speed such that the vaporizable liquid fluid injected into the burner can will distribute itself along and will be held against the interior wall 23 of the burner can by centrifugal force resulting from the high speed rotation of burner can 13 such that a cylindrical wall of vaporizable liquid fluid 41 forms a liquid liner between the combustion center and exterior cylindrical wall 23 of the burner can so that the burner can walls are cooled and the walls of flame gallery liners 28—28 are similarly cooled by this water wall. It should be noted that the invention contemplates providing by means of the described structure and the high speed rotation of the burner can a luquid liner or wall of vaporizable liquid fluid 41 in a rotary burner can even though said rotary burner can is in a generally horizontal plane. The presence of one or more flame gallery liners 28—28 will minimize the possibility of excessive frothing and splashing of foam into the combustion flame center during the vaporization process while at the same time heat generated by combustion flame 42 and absorbed into the flame gallery liner structure will be transferred through heat transfer fins 30—30 of flame gallery liners 28—28 into liquid liner 41 causing an additional portion of said liquid to boil such that the resulting vapor is allowed to work its way into and augment the flowing energy laden fluid stream.

Experience will indicate that rotary can burner 13 should be mounted in such manner as to allow the burner can to be tilted very slightly such that the vaporizable fluid 41 injected into the interior of said rotary can burner has a tendency to flow from the up-wind end of the can toward the fluid exit end of the can, or a similar result may be achieved by providing said burner can 13 with a tapered interior surface 43 of truncated conical shape such that the open cross section of the interior of the burner can increases in area as the cross section cut is moved from the upwind to the downwind end of the burner can as can be observed from careful examination of the tapering thickness of burner can wall 23 as illustrated in FIG. 2 of the drawings herein. Persons familiar with boiler operations will be aware that as vaporizable fluid liquid liner 41 is caused to boil, dissolved solids characterized by boiler scale will be precipitated from cylindrical fluid wall 41; a portion of the solidified combustion products of combustion flame 42 may also be captured by the liquid liner. Both said solid materials will mix together forming an undesirable sludge 44 that will collect along the interior surface of burner can 13 and it will be desirable to provide a means for elimination of said undesirable sludge 44. There are many varieties and designs of satisfactory automatic fluid control valves that could be implemented into the engine disclosed herein, and in illustrating a simple sludge drain opening 45, together with a pivoted value plug assembly 46 which incorporates a buoyant float 47 on the end of a lever arm, the inventor has simply meant to indicate that rotary burner can 13 should be provided with a suitable automatic means for eliminating sludge and excess vaporizable fluid 45, 46 and 47 as illustrated in FIGS. 1 and 2. Sludge and other fluid discharged through sludge drain opening 45 is collected by a circular gutter structure 48 which is provided with a sludge drain means 49.

A combination of combustion gasses and products and vaporised fluid are emitted from the rotary can burner 13 through fluid exit opening 27 to be directed by an auxiliary power turbine gas inlet duct 50 which feeds said fluid stream into a driven auxiliary power turbine wheel 51 which is rotatably mounted across the downstream opening of inlet duct 50 in such position as to be driven by the gasseous fluid flowing from the rotatable burner can. Said auxiliary power turbine wheel 51 is mounted on an auxiliary equipment power drive shaft 52 which is rotatably mounted between appropriate support bearing structures 53—53 and extending between the affixed to both the center of said auxiliary power turbine wheel 51 and the compressor rotor hub 19 of the input air compressor. Said equipment power drive shaft 52 is part of the means by which rotative energy developed by the auxiliary power turbine wheel 51 is coupled back to provide rotary drive to auxiliary and accessory equipment including providing rotary drive motion to input air compressor components 19–20.

At a previous point in this disclosure the inventor indicated that a flow of vaporizable fluid from vapor fluid reservoir 38 was driven by means of a suitable vapor fluid pump 39 through vapor fluid line 40 into the input or upwind end of rotary burner can 13. Said vapor fluid pump 39 could be driven by electricity or other suitable mechanical power means and the same is true of previously described fuel pump 35 which transports combustion fuel from associated fuel reservoir 34 through fuel line 36 and fuel injection nozzle 33 into rotary burner can 13. Although the drawings in this disclosure have illustrated a mechanical means of coupling rotative energy 54 to provide operative power to vapor fluid pump 39, and said mechanical means of coupling rotative energy 54 is continued on to provide rotary drive motion for fuel pump 35, the inventor does not intend to limit the described and claimed means of providing power to said auxiliary units to the mechanical gear train means illustrated.

As previously pointed out, rotary burner can 13 is rotatably supported in part by a spindle-hub and spoke assembly 15 mounted in support bearing 14 and by a plurality of can positioning rollers 16—16, and at least one of said can positioning rollers 16—16 is provided with rotary drive by a mechanical means for coupling rotary drive motion 55 from the auxiliary equipment drive shaft 52 through the mechanical gear train 54—54.

It is important to maintain a sufficient level of vaporizable fluid in liquid form in the interior of rotary burner can 13 such that a cylindrical liquid wall 41 is maintained against the spinning wall of the burner can and that as the liquid liner becomes partly used up by vaporization more vaporizable liquid be injected into the burner can. It is contemplated that this will be accomplished by means of a suitable liquid level sensing device 56 providing a feedback control signal through feedback line 57 to automatically control pump 39 and thus control the supply and flow of vaporizable liquid fluid into rotary burner can 13. It is also contemplated that the fuel supply will be controlled by a suitable throttle means integrated into fuel pump 35 or by any other suitable means for controlling the supply and flow of fuel to the fuel injection nozzle in said rotary burner can 13.

Immediately following the driven auxiliary power turbine wheel there is provided a suitably positioned generated gas directive duct 58 which captures and transmits the stream of generated vapor-gas into the operative portions of a suitable useful load device 59 which may be a power turbine unit designed to develop rotative power for conventional use; the exact nature or structure of the use to which the flow of energy laden gas-vapor stream is to be directed is not a contemplated part of this invention and the symbolic representation of a conventional power turbine unit 59 in FIG. 3 of the drawings herein is intended to merely provide a contextural illustration of an appropriate use of the combination steam-gas generator engine disclosed herein.

OPERATION OF THE INVENTION

In operation fuel from fuel reservoir 34 is driven by fuel pump 35 through fuel line 36 and injected by means of fuel injection nozzle 33 into the forward or upwind end of rotary burner can 13 where combustion is initiated by assistance of an appropriate ignition means 37 so that combustion flame 42 is produced in the approximate center of the forward or upwind end of rotary burner can 13. Said combustion process is dependent upon a supply of oxygen which may be provided by any appropriate suitable input air compressor 17 and routed by means of compressed air transmission duct 22 into the input or upwind end of rotary burner can 13. Concurrently with the application of air or oxygen input and injection of fuel into the burner can a supply of vaporizable liquid fluid 41 is fed from vapor fluid reservoir 38 with the assistance of vapor fluid pump 39 through vapor fluid line 40 into the input opening of rotary burner can 13 so that water or suitable fluid is caused to flow along cylindrical wall 23 of burner can 13 and in particular to occupy the space between flame gallery liners 28—28 and cylindrical wall 23.

As indicated in the description, cylindrical rotatable burner can 13 is constructed so that the entire can may be rotated on support rollers 16—16—16 when rotary drive energy is supplied to one of said rollers 16—16 or rotary motion is provided by any other suitable means. The invention contemplates that rotary burner can 13 will be rotated at such a great rate of speed that the water or other vaporizable fluid will be distributed against cylindrical wall 23 and be held in that position by centrifugal force, thus forming a cylindrical wall of vaporizable liquid fluid 41 all the way around and covering the interior surface of burner can 13. A portion of the heat from combustion flame 42 is absorbed by said spinning cylindrical wall of vaporizable liquid fluid 41 which causes part of the vaporizable fluid to boil. The vaporized product of the boiling process then combines with the flowing mass of combustion gasses and the combined volume of gasses are expelled from burner can 13 through fluid exit opening 27. This gas-vapor mixture is collected and directed by auxiliary power turbine inlet duct 50 to and through the blades of a driven auxiliary power turbine wheel 51 which when driven by said gas-vapor mixture develops rotary motion which is fed back through auxiliary equipment power drive shaft 52 to transmit rotary motion to input air compressor 17. Rotary motion may also be taken from said auxiliary equipment drive shaft 52 through suitable mechanical gear train 54—54 to operate vapor fluid pump 39, fuel pump 35, and to supply rotary drive motion to rotate the burner can and operate any other auxiliary equipment that may need rotary drive power.

After passing through auxiliary power turbine wheel 51, the moving gas-vapor mixture is then channeled through generated gas directive duct 58 which transmits the stream of generated gas-vapor mixture into the operative portions of a suitable load device 59 which may be a power turbine unit designed to convert the energy contained in the gas vapor mixture to some form of high speed rotary power.

ADVANTAGES OF THE INVENTION

A primary advantage of the invention is that the cylindrical liquid liner in the burner can allows engine operation at a sufficiently low temperature that the need for compression of excess air for engine cooling purposes is materially reduced.

A primary advantage of the invention is that the cylindrical liquid liner in the burner can, when heated to a sufficiently high temperature to boil, provides a source of vapor that is added to the already present flow of burned gasses thus increasing the mass of fluid from which useful power may be absorbed.

An advantage of the invention is that one or more flame gallery liners are provided within the burner can that first, act as heat transfer mediums for the flow of thermal energy from the flame to the cylindrical liquid liner of the burner can thus causing the liquid to evaporate and augment the fluid stream, and second, act to minimize the possibility of excessive frothing and splashing of foam into the combustion flame and fluid stream during the evaporation process.

An advantage of the invention is that a plurality of depending heat transfer fins are installed within the downwind end of the burner can which, by extending into the flow of heated gas-vapor fluid, absorb heat, which is in turn conducted by the set of heat transfer fins into the vaporizable liquid liner so that said liquid liner is more readily heated, and the amount of liquid that is vaporized and added to the fluid stream is increased, thereby augmenting the available power output of the engine.

An advantage of the invention is that an automatic means for eliminating sludge and excess vaporizable fluid from the burner can during operation is provided thus allowing a constant purging of the system of soot, boiler scale and other undesirable solid particulate materials.

An advantage of the invention is that the generated gas-vapor mixture supplied by the engine may be used to operate a power turbine unit of conventional design with minimum thermal damage to the various parts of the power turbine unit.

Although this specification describes but a single embodiment of the invention with certain applications thereof, it should be understood that structural or material rearrangement of adequate or equivalent parts, substitutions of equivalent functional elements and other modifications in structure can be made and other applications can be devised without departing from the spirit and scope of the invention. I therefore desire that the description and drawings herein be regarded as only an illustration of my invention and the invention be regarded as limited only as set forth in the following claims, or as required by the prior art.

Having thus described my invention, I claim:

1. A combination steam-gas generator engine comprising

A. a ground base support structure;

B. an engine bed frame supported by a conventional means at a spaced-apart distance from the ground base support structure with means for rotatably supporting a rotary can burner;

C. an input air compressor;

D. a compressed air transmission duct routed between the compressed air supply end of said input compressor and the input end of a rotary can burner;

E. a generally horizontally positioned rotatably mounted hollow tubular can burner structure having 1. a cylindrical wall,
2. an appropriate fuel injection nozzle with associated means of igniting fuel injected into the burner can.
3. a cylindrical wall of vaporizable liquid fluid forming a liquid liner on the interior wall of the burner can and held against said interior wall of the burner can by centrifugal force resulting from high speed rotation of the burner can,
4. at least one rotatable flame protecting flame gallery liner of a thermally conductive material concentrically mounted to and within the burner can near the fluid input end of the can and supported at a spaced-apart distance from the burner can wall, with the space between the outer portions of the flame gallery liner and the burner can wall being partially occupied by said cylindrical wall of vaporizable liquid fluid,
5. a fluid input means at one end of the burner can, and
6. a fluid output means at the opposite end of the burner can;

F. means of providing rotary drive motion to rotate the burner can;

G. an auxiliary power turbine gas inlet duct coupled to the downstream output end of the rotatable burner can;

H. a driven auxiliary power turbine wheel rotatably mounted in such position as to be driven by the gasseous fluid flowing from the rotatable burner can through the auxiliary power turbine gas inlet duct;

I. means of coupling rotative energy developed by the auxiliary power turbine wheel to auxiliary and accessory equipment;

J. a generated gas directive duct; coupled to

K. a useful load device;

L. means for controlling the supply and flow of vaporizable liquid fluid into the burner can;

M. means for controlling the supply and flow of fuel to the fuel injection nozzle in the burner can.

2. The combination steam-gas generator engine described in claim 1 in which the cylindrical wall of the burner can has a tapered interior surface such that the open cross section of the interior of the burner can increases in area as the cross section cut is moved from the upwind to downwind end of the burner can.

3. The combination steam-gas generator described in claim 1 in which each of the flame gallery liners is provided with a plurality of depending heat transfer fins extending from the exterior wall of said flame gallery liner into the space between the flame gallery liner and the wall of the burner can.

4. The combination steam-gas generator described in claim 1 in which the rotatable burner can is provided with an automatic means for eliminating sludge and excess vaporizable fluid.

5. The combination steam-gas generator described in claim 1 in which the generated gas drives a power turbine unit to develop rotative power for conventional use.

6. A combination steam-gas generator engine comprising:

A. a ground base support structure;

B. an engine bed frame supported by a conventional means at a spaced-apart distance from the ground base support structure with means for rotatably supporting a rotary can burner;

C. an input air compressor;

D. a compressed air transmission duct routed between the exit port of said input compressor and the input end of a rotary can burner;

E. a generally horizontally positioned rotatably mounted hollow tubular can burner structure having 1. a cylindrical outside wall,
2. an input lip ring partial closure on the upwind end of the burner can leaving a fluid input tuyere,
3. an output lip ring partial closure on the downwind end of the can leaving a fluid exit opening,
4. a flame gallery liner of thermally conductive material concentrically mounted within the upwind portion of the burner can at a spaced-apart distance from the burner can wall,
   a. at least one radial support web extending between and attached to the outer surface of the flame gallery liner and the inner surface of the burner can wall, with
   b. a plurality of mouse hole opening liquid passageways cut through the web in such manner as to permit liquid to flow through said web,
5. a plurality of generally longitudinal spaced-apart radial fins extending inward from the inner wall of the rotatable burner can with said radial fins starting at a spaced-apart distance from the trailing edge of the most downwind flame gallery liner and extending through substantially the remainder of the interior length of the burner can,
6. an appropriate fuel injection nozzle with associated means of igniting fuel injected into the burner can;

F. a cylindrical wall of vaporizable liquid fluid forming a liquid liner along the interior wall of the burner can and held against said interior a walls of the burner can by centrifugal force resulting from high speed rotation of the burner can;

G. means of providing rotary drive motion to rotate the burner can;

H. an auxiliary power turbine gas inlet duct coupled to the downstream output end of the rotatable burner can;

I. a driven auxiliary power turbine wheel rotatably mounted in such position as to be driven by the gaseous fluid flowing from the rotatable burner can through the auxiliary power turbine gas inlet duct;

J. means of coupling rotative energy developed by the auxiliary power turbine wheel to auxiliary and accessory equipment;

K. a generated gas directive duct; coupled to

L. a useful load device;

M. means for controlling the supply and flow of vaporizable liquid fluid into the burner can;

N. means for controlling the supply and flow of fuel to the fuel injection nozzle in the burner can.

7. The combination steam-gas generator described in claim 6 in which the cylindrical wall of the burner can has a tapered interior surface such that the open cross section of the interior of the burner can increases in area as the cross section cut is moved from the upwind to downwind end of the burner can.

8. The combination steam-gas generator described in claim 6 in which there is a plurality of flame gallery liners at successive spaced-apart positions within the interior of the upwind section of the burner can.

9. The combination steam-gas generator described in claim 6 in which each of the flame gallery liners is provided with a plurality of depending heat transfer fins extending from the exterior wall of said flame gallery liner into the space between the flame gallery liner and the wall of the burner can.

10. The combination steam-gas generator described in claim 6 in which the rotatable burner can is provided with an automatic means for eliminating sludge and excess vaporizable fluid.

11. The combination steam-gas generator described in claim 6 in which the generated gas drives a power turbine unit to develop rotative power for conventional use.

12. A combination steam-gas generator engine comprising:

A. a suitable ground base support structure;

B. an engine bed frame supported by a conventional means at a spaced-apart distance from the ground base support structure;

C. means for rotatably supporting a rotary can burner on the engine bed frame;

D. an input air compressor having
   1. a compressor housing-shroud,
   2. a compressor stator assembly positioned within the compressor housing-shroud,
   3. a compressor rotor hub, and
   4. a vaned-bladed rotor assembly attached to said rotor hub;

E. a compressed air transmission duct routed between the compressed air supply end of said input compressor and the input end of a rotary can burner;

F. a generally horizontally positioned rotatably mounted hollow tubular can burner structure having
   1. a cylindrical outside wall,
   2. an input lip ring partial closure on the upwind end of the burner can leaving a fluid input tuyere,
   3. an output lip ring partial closure on the downwind end of the can leaving a fluid exit opening,
   4. a flame gallery liner of thermally conductive material concentrically mounted within the upwind portion of the burner can at a spaced-apart distance from the burner can wall, having
      a. at least one radial support web extending between and attached to the outer surface of the flame gallery liner and the inner surface of the burner can wall, with
      b. a plurality of mouse-hole opening liquid passageways cut through the web in such manner as to permit liquid to flow through said web,
   5. a plurality of generally longitudinal spaced-apart radial fins extending inward from the inner wall of the rotatable burner can with said radial fins starting at a spaced-apart distance from the trailing edge of the most downwind flame gallery liner and extending through substantially the remainder of the interior length of the burner can,
   6. an appropriate fuel injection nozzle with associated means of igniting fuel injected into the burner can, and G. a cylindrical wall of vaporizable liquid fluid forming a liquid liner along the interior wall of the burner can and held against said interior walls of the burner can by centrifugal force resulting from high speed rotation of the burner can;

H. an auxiliary power turbine gas inlet duct coupled to the downstream output end of the rotatable burner can;

I. a driven auxiliary power turbine wheel rotatably mounted in such position as to be driven by the gaseous fluid flowing from the rotatable burner can through the auxiliary power turbine gas inlet duct;

J. an auxiliary equipment power drive shaft rotatably mounted within appropriate support bearing structures and extending between and affixed to both the center of said auxiliary power turbine wheel and the compressor rotor hub of the input air compressor;

K. a vapor fluid pump and associated vapor fluid reservoir;

L. means of coupling rotative energy from the auxiliary equipment drive shaft to said vapor fluid pump;

M. a fuel pump and associated fuel reservoir;

N. means of coupling rotative energy from the auxiliary equipment drive shaft to said fuel pump;

O. means for coupling rotary drive motion from the auxiliary equipment drive shaft to the rotatable burner can;

P. means for controlling the supply and flow of vaporizable liquid fluid into the burner can;

Q. means for controlling the supply and flow of fuel to the fuel injection nozzle in the burner can;

R. a generated gas directive duct; coupled to

S. a useful load device.

13. The combination steam-gas generator described in claim 12 in which the cylindrical wall of the burner can has a tapered interior surface such that the open cross section of the interior of the burner can increases in area as the cross section cut it moved from the upwind to downwind end of the burner can.

14. The combination steam-gas generator described in claim 12 in which there is a plurality of flame gallery liners at successive spaced-apart positions within the interior of the upwind section of the burner can.

15. The combination steam-gas generator described in claim 12 in which each of the flame gallery liners is provided with a plurality of depending heat transfer fins extending from the exterior wall of said flame gallery liner into the space between the flame gallery liner and the wall of the burner can.

16. The combination steam-gas generator described in claim 12 in which the rotatable burner can is provided with an automatic means for eliminating sludge and excess vaporizable fluid.

17. The combination steam-gas generator described in claim 12 in which the generated gas drives a power turbine unit to develop rotative power for conventional use.

* * * * *